US011008208B2

(12) United States Patent
Matsumoto et al.

(10) Patent No.: US 11,008,208 B2
(45) Date of Patent: May 18, 2021

(54) SPOUT FOR A REFILL CONTAINER

(71) Applicant: KAO GERMANY GMBH, Darmstadt (DE)

(72) Inventors: Shuhei Matsumoto, Darmstadt (DE); Frank Zeiter, Darmstadt (DE)

(73) Assignee: KAO GERMANY GMBH, Darmstadt (DE)

( * ) Notice: Subject to any disclaimer, the term of this patent is extended or adjusted under 35 U.S.C. 154(b) by 202 days.

(21) Appl. No.: 15/528,414

(22) PCT Filed: Nov. 3, 2015

(86) PCT No.: PCT/EP2015/075508
§ 371 (c)(1),
(2) Date: May 19, 2017

(87) PCT Pub. No.: WO2016/074979
PCT Pub. Date: May 19, 2016

(65) Prior Publication Data

US 2018/0339818 A1 Nov. 29, 2018

(30) Foreign Application Priority Data

Nov. 11, 2014 (EP) ..... 14192701

(51) Int. Cl.
*B67D 7/00* (2010.01)
*B65D 47/24* (2006.01)
(Continued)

(52) U.S. Cl.
CPC ..... *B67D 7/005* (2013.01); *B65D 47/2068* (2013.01); *B65D 47/2075* (2013.01);
(Continued)

(58) Field of Classification Search
CPC .. B65D 47/241; B65D 47/243; B65D 47/063; B65D 47/248; B65D 47/2068; B65D 47/2075; B67C 11/04; B67D 7/005
(Continued)

(56) References Cited

U.S. PATENT DOCUMENTS 1,672,983 A 6/1928 Mapel
2,641,376 A * 6/1953 Parziale ..... B65D 47/243 141/352
(Continued)

FOREIGN PATENT DOCUMENTS

AU 571 567 B2 4/1988
FR 943554 A * 3/1949 ..... B67C 11/04
(Continued)

OTHER PUBLICATIONS

International Search Report dated Jan. 27, 2016, dated Feb. 3, 2016.

*Primary Examiner* — Andrew D St. Clair
(74) *Attorney, Agent, or Firm* — Norris McLaughlin, P.A.

(57) ABSTRACT

A spout for a refill container having an outlet opening for communicating with an interior volume, a lid for sealing the outlet opening against a fluid located therein, wherein the lid is removable relative to the base part for unsealing the outlet opening, a nozzle for being inserted into an inlet opening of a bottle, wherein the nozzle is relative moveable to the base part between a closing position, and a pouring position, where the nozzle is positioned close to the base part, a flexible element, connected to the base part and the nozzle for providing a fluid connection of the nozzle with the outlet opening of the base part and a pusher removable relative to the base part by means of the nozzle, wherein the pusher pushes the lid away from the outlet opening in the pouring position of the nozzle for unsealing the outlet opening.

19 Claims, 5 Drawing Sheets

Figure 1:
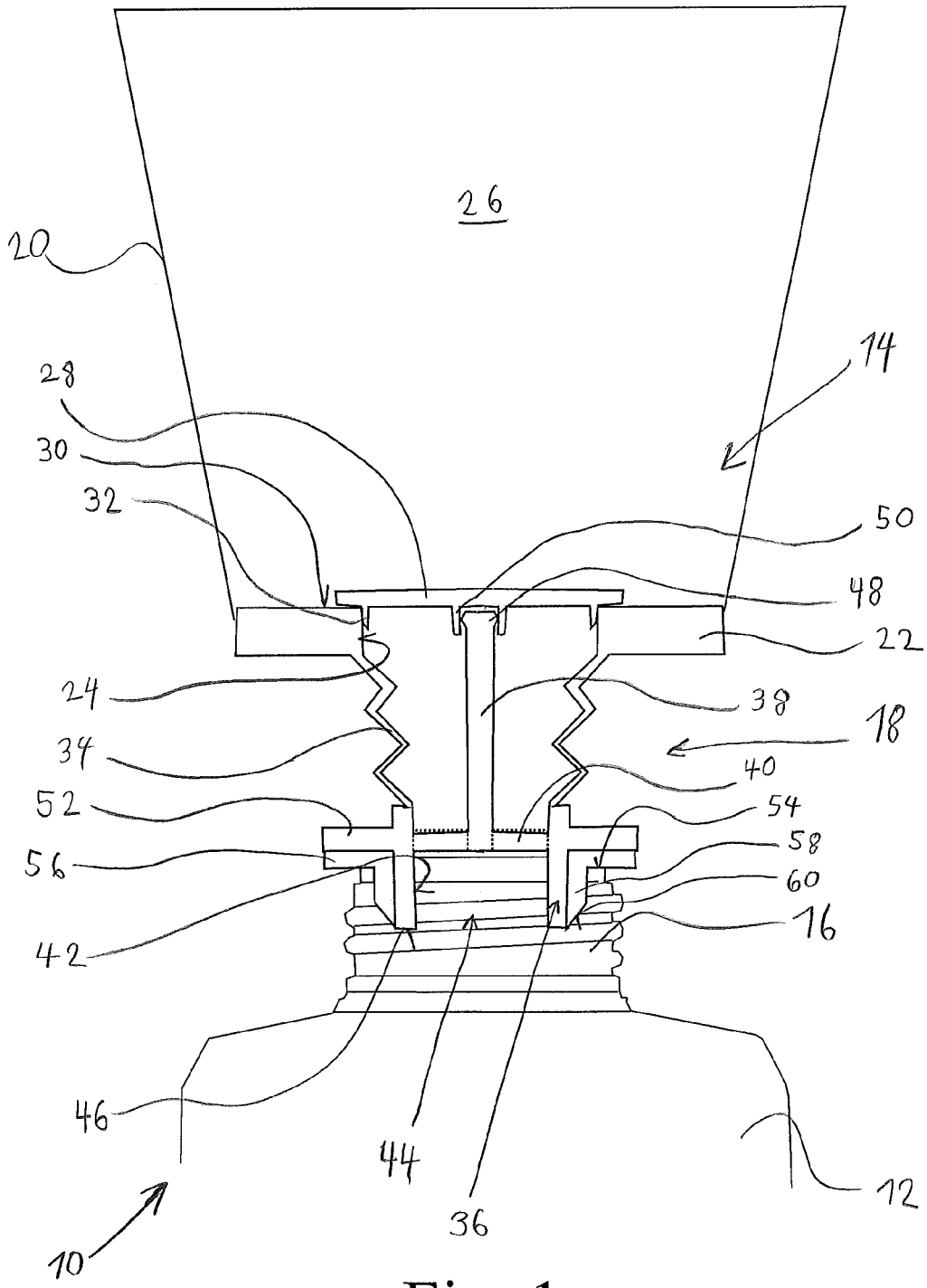

(51) Int. Cl.
*B65D 47/20* (2006.01)
*B65D 83/00* (2006.01)
*B65D 47/06* (2006.01)

(52) U.S. Cl.
CPC ..... *B65D 47/243* (2013.01); *B65D 47/248* (2013.01); *B65D 83/0055* (2013.01); *B65D 47/063* (2013.01)

(58) Field of Classification Search
USPC ..... 251/342
See application file for complete search history.

(56) References Cited

U.S. PATENT DOCUMENTS 3,355,238 A 11/1967 Schwartzman
3,545,874 A 12/1970 Schwartzman
4,116,365 A * 9/1978 Morganroth ..... A61K 8/02 132/208
4,707,279 A * 11/1987 Walls ..... F16K 21/04 251/339
5,320,260 A * 6/1994 Song ..... B65D 47/40 222/547
6,142,193 A * 11/2000 Sanders ..... B65B 39/04 141/300
6,227,419 B1 * 5/2001 Raboin ..... B67D 7/005 222/484
7,013,934 B1 * 3/2006 Hicok ..... B65B 39/00 141/297
2010/0021089 A1 * 1/2010 Arvizu ..... B65D 47/243 383/42
2012/0199503 A1 * 8/2012 Dyrbye ..... B65D 47/243 206/222
2012/0305519 A1 * 12/2012 Lee ..... B65D 51/2835 215/316

FOREIGN PATENT DOCUMENTS

FR 1 142 825 A 9/1957
JP 2000 062791 A 2/2000

* cited by examiner

SPOUT FOR A REFILL CONTAINER

This application is the U.S. National Stage of International Application No. PCT/EP2015/075508, filed Nov. 3, 2015, which claims foreign priority benefit under 35 U.S.C. § 119 of European Application No. 14192701.2 filed Nov. 11, 2014.

The invention relates to a spout for a refill container by means of which a fluid, particularly a fluid harmful for a human skin, can be poured into a bottle for dispensing this fluid.

From JP 2013 249 100 A a spout screwed to a refill container is known comprising a nozzle which can be inserted into an inlet opening of a bottle. The nozzle comprises a tube extending from an outlet of the refill container into the inlet opening of the bottle. The tube comprises an outlet opening communicating with an interior volume of the refill container and an outlet orifice communicating with an interior of the bottle. The outlet opening is closed by a lid arranged inside the outlet of the refill container. The spout further comprises a pusher resting on a front face of the inlet opening of the bottle, wherein the pusher is guided in a slit of the tube of the nozzle. When the refill container is pressed against the bottle the pusher moves relative to the nozzle towards the lid and pushes the lid away from outlet opening of the nozzle so that the fluid located in the interior volume of the refill container may flow into the bottle via the nozzle.

There is a permanent need for facilitating the refilling of a bottle, particularly by reducing the risk of spilling fluids harmful for a human skin.

It is the object of the invention providing measurements enabling a facilitated refilling of a bottle, particularly by reducing the risk of spilling fluids harmful for a human skin.

The solution of this object is provided according to the invention by a spout according to the features of claim 1. Preferred embodiments of the invention are given by the dependent claims and the following description, which can constitute each solely or in combination an aspect of the invention.

An aspect of the invention is directed to a spout for a refill container, particularly containing a harmful fluid, comprising a base part for being connected to the refill container, wherein the base part comprises an outlet opening for communicating with an interior volume of the refill container, a lid for sealing the outlet opening against a fluid located inside the interior volume of the refill container, wherein the lid is relative moveable to the base part for unsealing the outlet opening, a nozzle for being inserted into an inlet opening of a bottle, wherein the nozzle is relative moveable to the base part between a closing position, where the nozzle is positioned away from the base part, and a pouring position, where the nozzle is positioned close to the base part, a flexible element, particularly a spring bellow, connected to the base part and the nozzle for providing a fluid connection of the nozzle with the outlet opening of the base part and a pusher relative moveable to the base part by means of the nozzle, wherein the pusher pushes the lid away from the outlet opening in the pouring position of the nozzle for unsealing the outlet opening.

Due to the flexible element the nozzle may be relative moveable to the base part and loss-fit connected to the base part at the same time. The flexible element may collapse and/or may be compressed when the nozzle is moved from the closing position to the pouring position. Particularly just a linear action is sufficient for opening the spout so that the refilling may performed in an ergonomic and easy way.

Although the nozzle is relative moveable to the base part it may be prevented that the nozzle fall apart so that a facilitated handling of the spout is ensured. Particularly the flexible element provides a channel by which the nozzle may be in fluid connection with the base part. The base part, the flexible element and the nozzle may border a pouch volume which is only accessible via the outlet opening of the base part and an outlet orifice of the nozzle adapted for communicating with an interior of the bottle. During refilling of the bottle the outlet opening of the base part is arranged mainly in the refill container while the outlet orifice of the nozzle is arranged mainly in the bottle, particularly below the level of the inlet opening of the bottle. Since no further opening is provided by the spout which could be wetted by the fluid of the refill container a spilling of the fluid may be prevented or at least the risk of a spilling of the fluid may be reduced. Since the pusher is moved by the nozzle it is not necessary that the pusher is accessible from outside the spout. Hence an opening in the spout for operating the pusher can be saved so that the risk that fluid of the refill container may escape via this opening for the pusher may be eliminated. When the nozzle is moved from the closing position to the pouring position the pusher may press the lid out of the outlet opening of the base part so that the fluid of the refill container may flow into the bottle via the base part, the flexible element and the nozzle. The lid may stay inside the refill container and do not fall into the bottle. Due to the flexible element the nozzle may move relative to the base part in order to open the outlet opening of the base part via the pusher pushing against the lid without the need of additional openings where fluid of the refill container may escape to the environment so that a reduced risk of spilling fluid of the refill container and therefore a facilitated refilling of a bottle is enabled.

The flexible element may be just a foil or a bag. Particularly the flexible element is designed as an elastic element for pushing the nozzle away from the base part into the closing position. The flexible element may provide a spring force in the closing position of the nozzle so that an unintentional moving of the nozzle, particularly a rattling of the nozzle, may be prevented. When the nozzle should be moved intentionally for opening the refill container the spring force of the flexible element has to be overcome. The flexible element may be designed as a formed rubber block comprising a channel for providing the fluid communication of the nozzle with the outlet opening of the base part. Particularly the flexible element is designed as a bellow, preferably a spring bellow, which may collapse and unfold in a predefined manner and provide a hollow space for providing the fluid communication of the nozzle with the outlet opening of the base part. The flexible element may be designed as a bellow with a spiral structure. Particularly the flexible element is made from an elastomeric material or from a thermoplastic material with a sufficient thin material thickness for providing the required flexibility. Particularly the only connections to the environment of the channel located inside the spout are the outlet opening of the base part and the outlet orifice of the nozzle. Particularly, the nozzle defines a distal end of the spout, this means that after the level of an front face of an outlet orifice of the mainly rigid nozzle no further part of the spout is present in a direction pointing away from the lid.

The refill container may be designed as a refill bag comprising a flexible wall so that the refill container may be compressed for squeezing the fluid located inside the interior volume of the refill container out of the refill container via the spout. Further it is possible that the refill container may be made from a rigid material, wherein particularly the fluid may be pressed out of the interior volume of the refill container by means of an actuating means. For instance the refill container may be designed as an airless container comprising a cylinder and a piston moveable guided inside the cylinder for pumping the fluid out of the interior volume of the refill container via the spout.

The pusher may be a separate part to the nozzle and the base part which may be arranged between the nozzle and the base part. When the nozzle is moved from the closing position towards the pouring position the nozzle may meet the pusher at a certain distance or right from the beginning of the movement on and press the pusher against the lid. The lid may provide a fluid tight sealing and may be connected to the base part with a sufficient sealing force. When the pusher is pressed against the lid the forces keeping the lid fluid tight in position can be overcome for opening the outlet opening of the base part. The pusher may be designed as a stem arranged at least partially inside the flexible element. Particularly the pusher may be connected to the nozzle and/or the lid or may be one piece with the nozzle and/or the lid.

The base part provides a sufficient part for being connected to the refill container. Particularly the refill container may be fixed to the material of the base part by bonding, welding, particularly ultrasonic welding, or the like. The base part may be made from a rigid material compared to the material of the refill container. Particularly the base part and/or the nozzle and/or the lid and/or the pusher may be made from a thermoplastic material. Particularly the flexible element may be connected to the base part and the nozzle by bonding, welding, particularly ultrasonic welding, 2 component injection molding or the like. In the alternate the elastic element may be one-piece with the base plate and/or with the nozzle. The flexible element may be molded one-piece with the base plate and/or with the nozzle particularly with thermoplastic material. In this case the flexible element may comprise a thinner material thickness compared to the material thickness of the base part and/or the nozzle for providing a sufficient flexibility Particularly the pusher is arranged mainly coaxial to the nozzle and/or the outlet opening. The pusher may be positioned radially spaced to the material of the flexible element so that the flexible element does not meet the pusher when the nozzle is moved from the closing position towards the pouring position and compresses the flexible element. Further the pusher may meet the lid mainly centrally in a center of gravity of the lid so that the lid may be moved out of the outlet opening of the base part without being tilted inside the outlet opening. The pusher may comprise a comparatively small cross section area so that the hydraulic diameter between the outlet opening of the base part and an outlet orifice of the nozzle is not significantly reduced, wherein at the same time an easy opening of the outlet opening is provided. The pusher comprises a cross section area $A_P$ and the outlet opening comprises a cross section area $A_O$, wherein particularly $0.002 \leq A_P/A_O \leq 0.20$, preferably $0.01 \leq A_P/A_O \leq 0.10$ and particularly preferred $A_P/A_O \leq 0.025 \pm 0.015$ applies.

Preferably the pusher is connected to the nozzle, particularly via at least one bridge, and/or to the lid, particularly via a stem press-fitted into a collar. Particularly the pusher is arranged spaced to the nozzle radially inwards with respect to the nozzle and connected to nozzle via the bridges or the like for bridging the gap between the pusher and the nozzle. The nozzle may cover a part of the pusher by in radial view. The pusher may be arranged coaxially with respect to the nozzle. The bridges may comprise a comparatively small wall thickness in circumferential direction so that the hydraulic cross section area of the nozzle is not significantly impaired. Particularly all provided bridges cover an Area A of an hydraulic cross section area $A_n$ of the nozzle without bridges, wherein $0.01 \leq A/A_h \leq 0.25$, particularly $0.02 \leq A/A_h \leq 0.15$, preferably $0.03 \leq A/A_h \leq 0.10$ and particularly $0.04 \leq A/A_h \leq 0.05$ applies. The pusher may be loss-proof connected to the nozzle and/or to the lid. A rattling of the pusher may be prevented. Particularly the pusher may be one-piece with the nozzle and/or the collar. The number of assembling parts may be reduced. When the pusher is fixed to both the nozzle and the lid, it is even possible that the nozzle may move the lid into the outlet opening and/or may apply a force to the lid for pressing the lid against the base part increasing the sealing effect between the lid and the base part. Particularly the flexible element provides a spring force for pushing the nozzle away from the base part, which in turn presses the lid against the base part with an increased sealing effect.

Particularly preferred the nozzle comprises an outlet orifice at a front face of the nozzle pointing away from the base plate, wherein the pusher and/or a connecting element, particularly at a bridge, connecting the pusher to the nozzle are arranged between the level of the front face and the lid. The pusher does not protrude outside the nozzle so that the pusher is protected inside the spout. Further the hydraulic diameter of the nozzle at the level of the front face is not reduced by the cross section of the pusher so that a high volume flow may be achieved.

Particularly the lid comprises a sealing ring pressed into the outlet opening of the base part in the closing position of the nozzle. The sealing ring may or may not be provided with a sealing material, like an elastomeric or rubber material. The sealing ring may be designed as a collar pressed into a correspondent shape of the outlet opening. The sealing ring may provide a sealing force directed in radial direction of the outlet opening. The sealing effect of the lid may be adjusted by the area of the surfaces pressed against the material of the base part and/or the chosen press fit between the sealing ring and the outlet opening.

Preferably the lid overhang the outlet opening of the base part at an axial inner face of the base part pointing away from the nozzle. The lid may protrude the outlet opening in radial direction and may provide a sealing force in axial direction of the outlet opening. The sealing effect of the lid may be adjusted by the area of the surfaces pressed against the material of the base part and/or an axial force by which the lid is pressed against the axial inner face of the material of the base part surrounding the outlet opening. Particularly the base part may comprise a collar for keeping the lid pressed to the base part.

Particularly preferred the hydraulic diameter of the outlet opening is larger than the minimum hydraulic diameter of the flexible element and the minimum hydraulic diameter of the nozzle. Due to the comparatively large hydraulic diameter of the outlet opening the spout may act like a funnel so that a high volume flow when discharging a fluid via the spout may be achieved. Further the comparatively large diameter of the outlet opening enables an facilitated molding of the base part. If so, the minimum hydraulic diameter of the flexible element is larger than the minimum hydraulic diameter of the nozzle.

Particularly the nozzle comprises a shoulder plate protruding radially outwards from the nozzle for resting on an axial front face of the inlet opening of the bottle, wherein particularly the shoulder plate provides at least one degassing vent for degassing air from an interior of the bottle. The extension of the shoulder plate in radial direction may be larger than the inlet opening of the bottle so that the shoulder plate may rest on the front face of the inlet opening at any position of the nozzle relative to the inlet opening. The nozzle may abut an inner face of the inlet opening wherein at the same time the shoulder plate still rests on the front face of the inlet opening at the opposing side of the inner surface. Due to the shoulder plate and the nozzle at least partially inserted into the inlet opening of the bottle it is not necessary to screw the spout with the bottle and/or to tilt the bottle during filling the bottle with the content of the refill container. Further no adapter is necessary to attach the spout with the bottle. The handling for refilling the bottle may be facilitated. Due to the degassing vent provided in the shoulder plate air from inside the bottle which is displaced by the fluid poured into the bottle may easily escape the bottle via the degassing vent without flowing into the refill container via the spout. The filling of the bottle may be further facilitated and/or accelerated.

Preferably the nozzle comprises fins protruding radially outwards from the nozzle for resting on an inner surface of the inlet opening of the bottle and/or on an axial front face of the inlet opening of the bottle, wherein between the fins degassing channels for degassing air from an interior of the bottle are provided. Particularly the respective fin comprises an inserting chamfer. The fins provided with the insertion chamfer may facilitate the insertion of the nozzle into the inlet opening of the bottle. Due to the space between the fins providing the degassing channel air from inside the bottle which is displaced by the fluid poured into the bottle may easily escape the bottle via the degassing channel without flowing into the refill container via the spout. The filling of the bottle may be further facilitated and/or accelerated.

Particularly preferred a locking device is provided between the base part and the nozzle for limiting and/or blocking a relative movement of the nozzle to the base part, wherein particularly the locking device is releasably clipped with the flexible element. The locking device may abut the nozzle and the base plate so that the movement of the nozzle from the closing position towards the pouring position may be at least limited or even blocked. An unintentional opening of the spout may be prevented by the locking device. Particularly the locking device is releasably connected to the spout so that the locking device may be detached first before the spout is opened by moving the nozzle into the pouring position for unsealing the outlet opening of the base part.

A further aspect of the invention is directed to a packaging, particularly for refilling a bottle with a fluid, comprising a flexible bag filled with a fluid and a spout which may be designed as previously described connected with the bag for pouring out the fluid. Due to the flexible element of the spout the nozzle may move relative to the base part in order to open the outlet opening of the base part via the pusher pushing against the lid without the need of additional openings where fluid of the refill container may escape to the environment so that a reduced risk of spilling fluid of the refill container and therefore a facilitated refilling of a bottle is enabled.

Particularly a spring force of the flexible element provided in the closing position of the nozzle is higher than a maximum weight of the fluid applied to a part of the base plate outside the lid. An unintentional opening of the spout due to the weight of the content of the packaging when positioned upside down can be prevented.

Preferably the fluid is a surfactant, particularly a detergent, a softener and/or a hair tinting means. Due to the secure sealing of the refill container and the reduced risk of spilling fluid during filling a bottle the packaging is suitable even for fluids which are more dangerous for a human than other fluids. The fluid may be harmful to a human skin, fabric and/or furniture. For instance the fluid may change color and/or bleach out a fabric and/or furniture. Particularly the fluid may be irritating for a human skin and may be classified with a GHS code of GHS07 or GHS08.

Particularly preferred the fluid comprises a chemical component harmful to a human skin, fabric and/or furniture, particularly $H_2O_2$, NaClO, hair dye. For instance the fluid may change color and/or bleach out a fabric and/or furniture. Due to the secure sealing of the refill container and the reduced risk of spilling fluid during filling a bottle the packaging is suitable even for fluids comprising a chemical component which is more dangerous for a human than other fluids. Particularly the chemical component may be irritating for a human skin and may be classified with a GHS code of GHS07 or GHS08.

A further aspect of the invention is directed to a refill system comprising a bottle to be filled with a fluid, wherein the bottle comprises an inlet opening, and a packaging which may be designed as previously described for filling the bottle with the fluid, wherein the nozzle of the spout is at least partially inserted into the inlet opening. Due to the flexible element of the spout the nozzle may move relative to the base part in order to open the outlet opening of the base part via the pusher pushing against the lid without the need of additional openings where fluid of the refill container may escape to the environment so that a reduced risk of spilling fluid of the refill container and therefore a facilitated refilling of a bottle is enabled.

Figure 2:
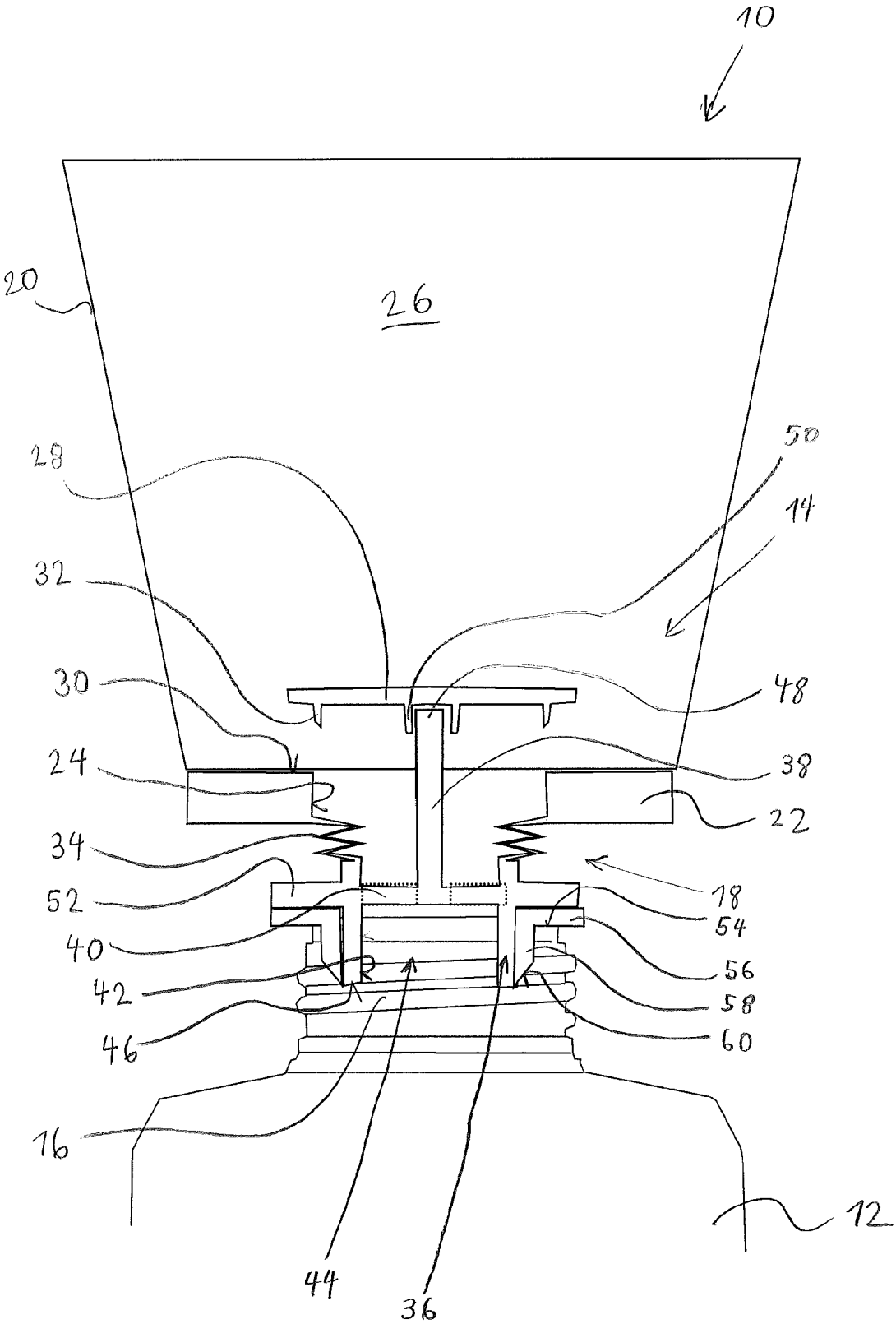
Figure 3:
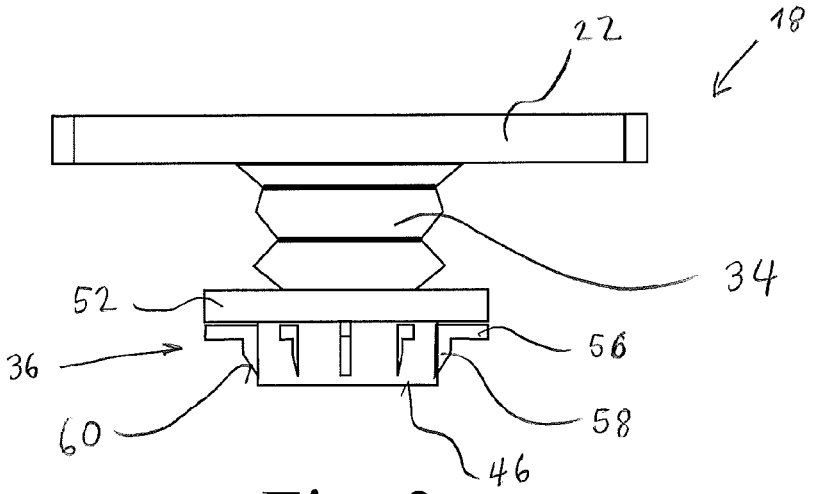
Figure 4:
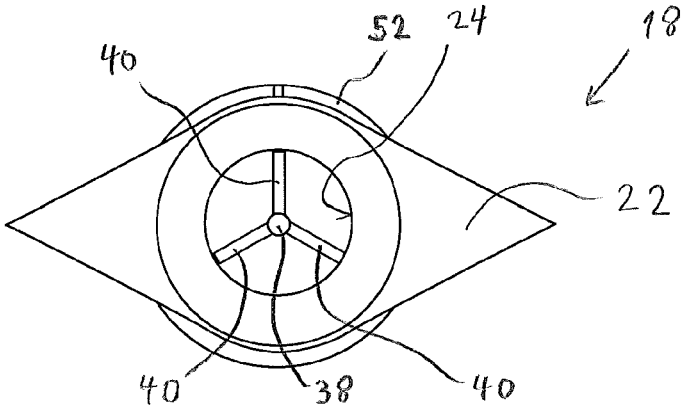
Figure 5:
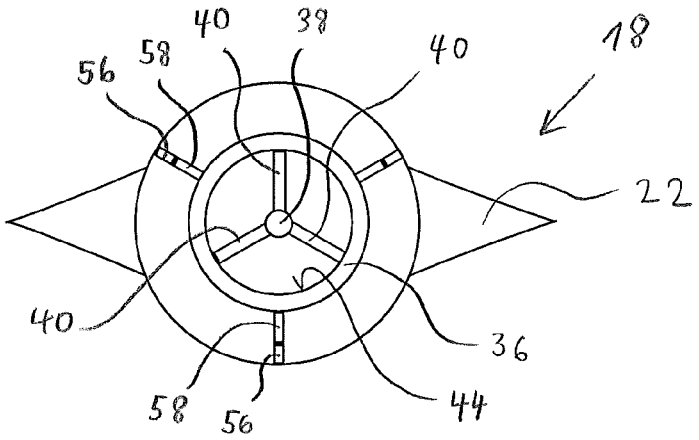
Figure 6:
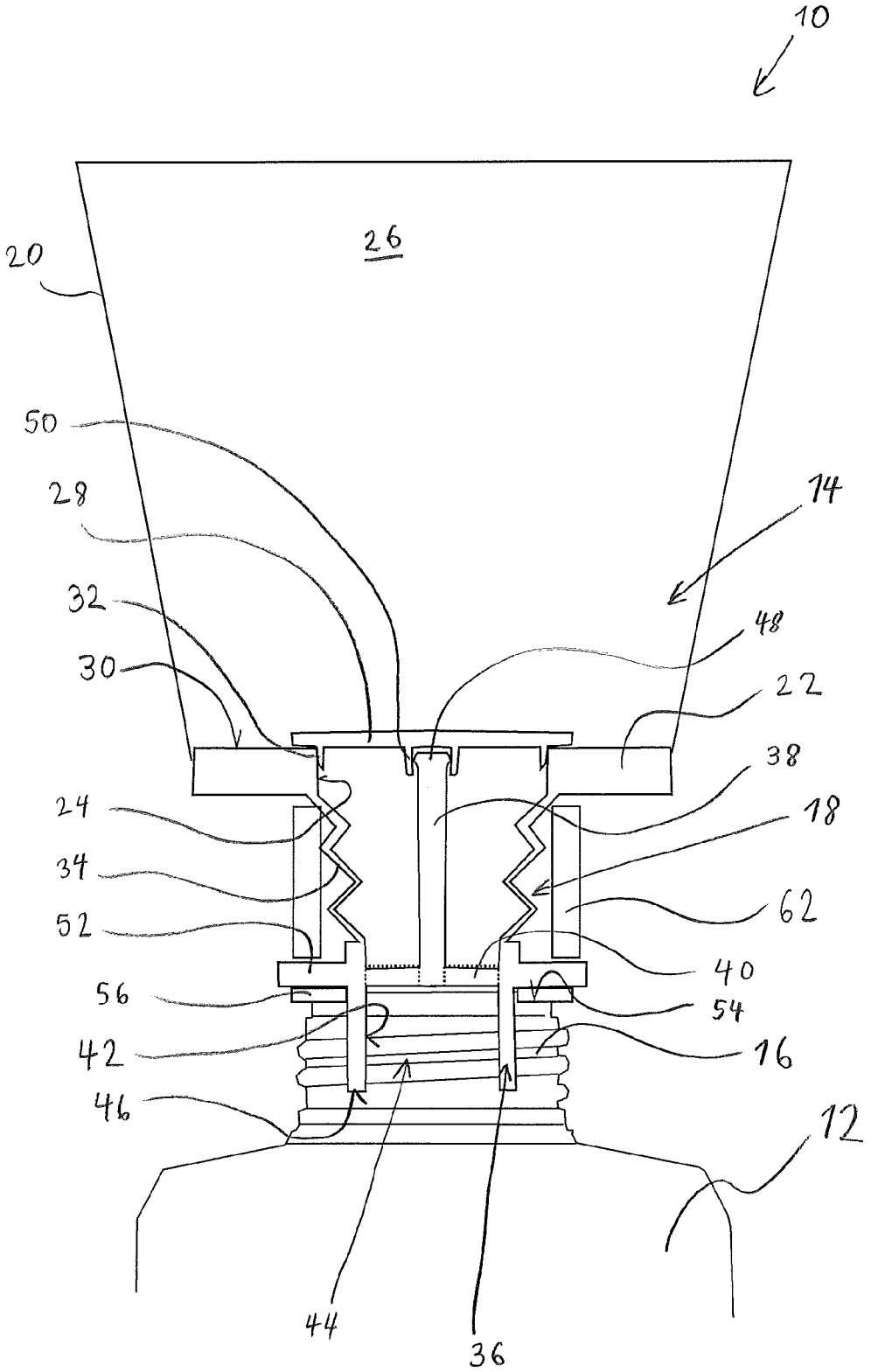
Figure 7:
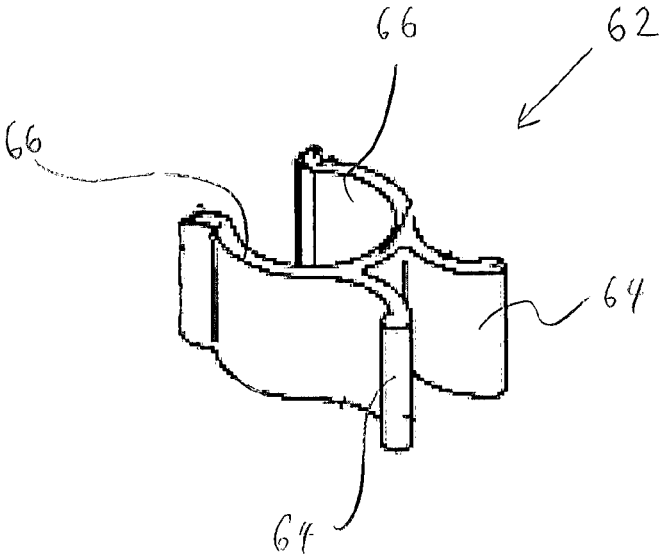
Figure 8:
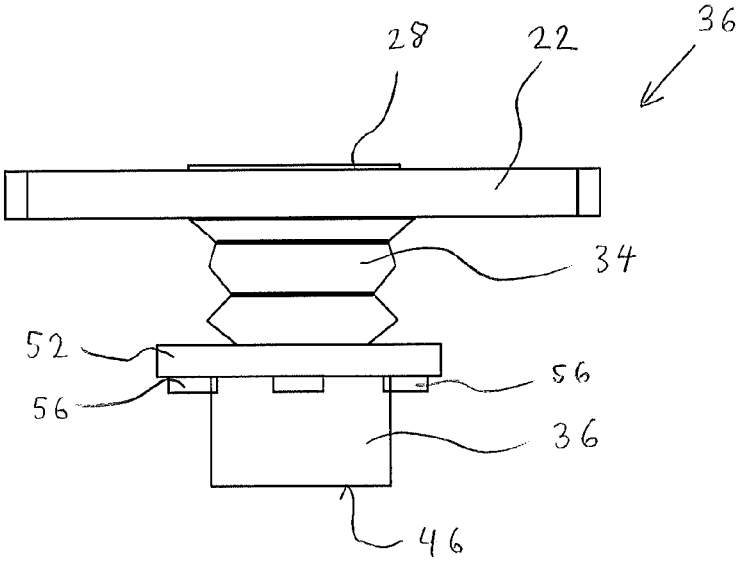

These and other aspects of the invention will be apparent from and elucidated with reference to the embodiments described hereinafter, wherein the described features can constitute each solely or in combination an independent aspect of the invention. In the drawings:

FIG. 1: is a schematic sectional side view of a first embodiment of a refill system in closed position, FIG. 2: is a schematic sectional side view of the refill system of FIG. 1 in opened position, FIG. 3 is a schematic side view of a spout of the refill system of FIG. 1, FIG. 4: is a top view of the spout of FIG. 3, FIG. 5: is a bottom view of the spout of FIG. 3, FIG. 6: is a schematic sectional side view of a second embodiment of a refill system in closed position, FIG. 7: is a schematic perspective view of a locking device of the refill system of FIG. 6 and FIG. 8: is a schematic side view of a spout of the refill system of FIG. 6.

The refill system 10 as illustrated in FIG. 1 comprises a bottle 12 which can be refilled with a fluid by means of a packaging 14 inserted into an inlet opening 16 of the bottle 12 via a spout 18. The packaging 14 comprises a refill container designed as a flexible refill bag 20 providing a pouch which can be filled with a fluid which may be harmful and/or irritating for a human skin like $H_2O_2$. The refill bag 20 may collapse by atmosphere pressure and may be pressed together for squeezing the fluid out of the flexible bag 20.

The flexible bag 20 is closed by a base plate 22 of the spout 18. The base plate 22 comprises an outlet opening 24 for communicating with an interior volume 26 of the refill bag 20. In the illustrated closing position of the spout 18 the outlet opening 24 is closed and sealed by means of a lid 28. The lid 28 is positioned inside the interior volume 26 of the refill bag 20 and overhangs an axial inner front face 30 of the base part 22 pointing towards the interior volume 26. The lid 28 comprises a sealing ring 32 which is press-fitted inserted into the outlet opening 24 for providing a sufficient fluid tight sealing.

The base plate 22 is connected via a flexible element 34 designed as spring bellow to a nozzle 36. The base plate 22, the flexible element 34 and the nozzle 36 may be separate parts or one-piece. In the illustrated embodiment the nozzle 36 is fixed to a pusher 38 via bridges 40 arranged inside a discharge channel 42 of the nozzle. One end of the discharge channel 42 pointing away from the flexible element 34 defines an outlet orifice 44 in a front face 46 of the nozzle 18 pointing away from the flexible element 34. In the alternate the pusher 38 may be also fixed to the lid 28, fixed only to the lid 28, fixed to both the nozzle 36 and the lid 28 or to none of the nozzle 36 and the lid 28. Particularly the pusher 38 is one-piece with the part to which the pusher 38 is fixed. In the illustrated embodiment the pusher 38 is, if so releasably, connected to the lid 28. The pusher 38 is designed as a stem comprising a head part 48 press-fitted inserted into a corresponding collar 50 of the lid 28.

The nozzle 36 comprises a shoulder plate 52 protruding from the nozzle 36 in radial direction overhanging the inlet opening 16 of the bottle 12. The shoulder plate 52 rests on an axial front face 54 of the inlet opening 16 via first fins 56 arranged in radial direction. The first fins 56 are connected to second fins 58 arranged in axial direction of the nozzle 36 so that between subsequent fins 56, 58 in circumferential direction a degassing channel is provided. The second fins 58 comprises an insertion chamfer 60 each for facilitating the insertion of the nozzle 36 of the spout 18 into the inlet opening 16 of the bottle 12 providing the refill system 10.

For refilling the bottle 12 the nozzle 36 may be moved from the closing position as illustrated in FIG. 1 to a pouring position as illustrated in FIG. 2. For that purpose the base plate 22 may be pressed downwards towards the bottle 12 particularly by squeezing the flexible refill bag 20. Due to the squeezed refill bag 20 the pressure of the fluid inside the interior volume 26 of the refill bag 20 may increase until the spring force provided by the flexible element 34 may be overcome so that the base plate 22 moves towards the nozzle 36. The lid 28 clamped inside the outlet opening 24 of the base plate 22 is pressed out of the outlet opening 24 by means of the pusher 38 pressing against the lid 28 and supported via the bridges 40 by the nozzle 36. The fluid located inside the interior volume 26 of the refill bag 20 may pass the lid 28 and may flow through the outlet opening 24 of the base plate 22 and a channel provided by the flexible element 34 and the nozzle 36 to the outlet orifice 44 where the fluid flows into the bottle 12.

The spout 18 is illustrated in further details in FIG. 3 to FIG. 5. As can be derived particularly from FIG. 4 and FIG. 5 the hydraulic diameter of the channel provided by the base part 22, the flexible element 34 and the nozzle 36 is only slightly reduced by the bridges 40 and the pusher 38.

As illustrated in FIG. 6 the spout 18 may be provided with a locking device 62. The locking device 62 may block a movement from the nozzle 36 relative to the base part 22 so that the nozzle 36 is kept in the closing position and may not reach the pouring position. As illustrated in FIG. 7 the locking device 62 may designed like a clip connector which may be releasably clipped to the flexible element 34. The locking device 62 may comprises two arms 64 which may be pressed together by the hand of a user for opening clamp elements 66 of the locking device 62 so that the user may release the locking device 62 from the spout 18 with ease. After the locking device 62 is released from the spout 18 the nozzle 36 may be moved from the closing position to the pouring position.

As illustrated in FIG. 8 the nozzle 36 of the spout 18 may lack the second fins 58. Sufficient degassing channels are provided by the first fins 56 only.

The invention claimed is:

1. A spout configured for a refill container comprising:

a base part configured for being connected to the refill container, wherein the base part comprises an outlet opening configured for communicating with an interior volume of the refill container;

a lid configured for sealing the outlet opening against a fluid located inside the interior volume of the refill container, wherein the lid is moveable with respect to the base part for unsealing the outlet opening;

a nozzle insertable into an inlet opening of a bottle, wherein the nozzle is moveable with respect to the base part between a closing position, where the nozzle is positioned away from the base part, and a pouring position, where the nozzle is positioned adjacent to the base part, wherein the nozzle comprises a shoulder and a discharge channel defined by an inner circumferential wall of the nozzle;

a flexible element connected to the base part and the nozzle and configured for providing a fluid connection of the nozzle with the outlet opening of the base part;

a locking device which is configured to abut the shoulder of the nozzle and the base part to prevent movement of the nozzle relative to the base part, wherein the locking device includes clamp elements which fit around the flexible element and two arms configured to be pressed together to open the clamp elements;

a pusher moveable with respect the base part by means of the nozzle, wherein the pusher pushes the lid away from the outlet opening in the pouring position of the nozzle for unsealing the outlet opening; and bridges connecting the pusher to the nozzle, wherein the bridges, in their entireties, are arranged inside the discharge channel of the nozzle.

2. The spout according to claim 1, wherein the pusher is arranged mainly coaxial to at least one selected from the nozzle and the outlet opening, the bridges cover an Area A of a hydraulic cross section area $A_h$ of the nozzle without bridges, and wherein $0.01 \leq A/A_h \leq 0.25$ applies.

3. The spout according to claim 1, wherein the pusher is connected to the lid via a stem press-fitted into an inner collar of the lid.

4. The spout according to claim 1, wherein the nozzle comprises an outlet orifice at a front face of the nozzle pointing away from the base part, wherein the pusher, at the bridges connecting the pusher to the nozzle, is arranged between the level of the front face and the lid.

5. The spout according to claim 1, wherein the lid comprises a sealing ring pressed into a corresponding shape of the outlet opening of the base part in the closing position of the nozzle.

6. The spout according to claim 1, wherein the lid overhangs the outlet opening of the base part at an axial inner face of the base part pointing away from the nozzle.

7. The spout according to claim 1, wherein the hydraulic diameter of the outlet opening is larger than the minimum hydraulic diameter of the flexible element and the minimum hydraulic diameter of the nozzle.

8. The spout according to claim 1, wherein the nozzle comprises a shoulder plate protruding radially outwards from the nozzle for resting on an axial front face of the inlet opening of the bottle, wherein the shoulder plate provides at least one degassing vent for degassing air from an interior of the bottle.

9. The spout according to claim 1, wherein the nozzle comprises fins protruding radially outwards from the nozzle for resting on an inner surface of the inlet opening of the bottle and/or on an axial front face of the inlet opening of the bottle, wherein between the fins degassing channels for degassing air from an interior of the bottle are provided.

10. The spout according to claim 1, wherein the locking device is releasably clipped to the flexible element.

11. A packaging configured for refilling a bottle with a fluid, the packaging comprising:

a flexible bag filled with a fluid; and the spout, according to claim 1, connected with the bag for pouring out the fluid.

12. The packaging according to claim 11, wherein a spring force of the flexible element provided in the closing position of the nozzle is higher than a maximum weight of the fluid applied to a part of the base plate outside the lid.

13. The packaging according to claim 11, wherein the fluid is at least one selected from a surfactant, a softener and a hair tinting means.

14. The packaging according to claim 11, wherein the fluid comprises a chemical component harmful to at least one selected from a human skin, fabric and furniture.

15. A refill system comprising:

a bottle to be filled with a fluid, wherein the bottle comprises an inlet opening; and the packaging according to claim 11, wherein the nozzle of the spout is at least partially inserted into the inlet opening.

16. The spout according to claim 1, wherein the flexible element is a collapsible and unfoldable bellow consisting of a spring bellow.

17. The spout according to claim 1, wherein the bridges extend outwardly away from the pusher in a radial direction within the discharge channel of the nozzle.

18. The spout according to claim 2, wherein $0.04 \leq A/A_h \leq 0.05$ applies.

19. The spout according to claim 5, wherein the sealing ring of the lid is an outer collar pressable into the corresponding shape of the outlet opening of the base part.

* * * * *